US006044239A

United States Patent [19]

Russell

[11] Patent Number: 6,044,239

[45] Date of Patent: Mar. 28, 2000

[54] MOLDED ROLLER WITH SLIDE MECHANISM

[75] Inventor: Robert D. Russell, Pittsford, N.Y.

[73] Assignee: Xerox Corporation, Stamford, Conn.

[21] Appl. No.: 09/122,746

[22] Filed: Jul. 27, 1998

[51] Int. Cl.[7] ..... G03G 15/00

[52] U.S. Cl. ..... 399/107; 312/330.1; 399/124

[58] Field of Search ..... 399/107, 110, 399/111, 113, 124, 115, 116, 119, 121, 122, 123, 393; 312/330.1, 334.1, 334.4, 334.8, 334.9, 334.12, 334.13

[56] References Cited

U.S. PATENT DOCUMENTS

| | | | |
|---|---|---|---|
| 3,574,421 | 4/1971 | Stein et al. | 312/334.4 X |
| 3,584,925 | 6/1971 | Himelreich | 312/330.1 X |
| 4,181,383 | 1/1980 | Naef | 312/334.13 X |
| 4,332,458 | 6/1982 | Hoffman | 399/149 |
| 4,378,154 | 3/1983 | Hoffman | 399/165 |
| 4,437,715 | 3/1984 | Jenkins | 312/330.1 X |
| 4,835,567 | 5/1989 | Ogata | 399/124 |
| 4,876,606 | 10/1989 | Banno et al. | 358/434 |
| 4,990,966 | 2/1991 | Sindo | 399/124 |
| 5,134,443 | 7/1992 | Sumi et al. | 399/124 X |
| 5,152,517 | 10/1992 | Ruch et al. | 271/9.08 |
| 5,157,448 | 10/1992 | Lang | 399/23 |
| 5,250,993 | 10/1993 | Seyfried et al. | 399/105 |
| 5,400,121 | 3/1995 | Foote | 399/116 |
| 5,470,144 | 11/1995 | Wen | 312/334.13 |
| 5,715,500 | 2/1998 | Nakazato et al. | 399/124 |
| 5,733,026 | 3/1998 | Munachen | 312/334.12 |
| 5,823,647 | 10/1998 | Miyoshi | 312/334.4 |

*Primary Examiner*—Sandra Brase
*Attorney, Agent, or Firm*—Andrew D. Ryan

[57] ABSTRACT

A slide mechanism for mounting a sliding member to a housing is provided. The mechanism includes a body having first and second opposed surfaces. The sliding member is mountable to the body. The mechanism also includes a plurality of journals extending from the body. Each of the plurality of journals has a central axis thereof. The mechanism also includes a plurality of rollers. Each of the plurality of rollers is rotatably fitted to one of the plurality of journals. The plurality of rollers is operably connectable to the housing. At least one of the body and the plurality of journals are molded from a moldable material.

19 Claims, 12 Drawing Sheets

MOLDED ROLLER WITH SLIDE MECHANISM

This invention relates generally to a slide mechanism for a printing machine, and more particularly concerns a roller slide mechanism for a printing machine.

In a typical electrophotographic printing process, a photoconductive member is charged to a substantially uniform potential so as to sensitize the surface thereof. The charged portion of the photoconductive member is exposed to a light image of an original document being reproduced. Exposure of the charged photoconductive member selectively dissipates the charges thereon in the irradiated areas. This records an electrostatic latent image on the photoconductive member corresponding to the informational areas contained within the original document. After the electrostatic latent image is recorded on the photoconductive member, the latent image is developed by bringing a developer material into contact therewith. Generally, the developer material comprises toner particles adhering triboelectrically to carrier granules. The toner particles are attracted from the carrier granules to the latent image forming a toner powder image on the photoconductive member. The toner powder image is then transferred from the photoconductive member to a copy sheet. The toner particles are heated to permanently affix the powder image to the copy sheet. After each transfer process, the toner remaining on the photoconductor is cleaned by a cleaning device.

In the printing machine subscribed above, the copies are produced by transferring developer material onto copy sheets. These copy sheets are typically stored within the printing machine. The sheets are stored internally within the machine in order to protect the copy substrate from contamination and to stage the copy sheets for cooperation with the feed rolls of the paper feeding portion of the copy machine. Typically, to permit for easy loading of additional paper into the paper trays, the trays are mounted on ways or guides and may be slid horizontally forwardly from the front of the machine.

In addition to the paper trays, printing machines and copiers, as well as other types of equipment, to assist in serving an access to the internal workings of the machine, include modules or portions of the machine. The modules are mounted together in a subframe or assembly which is slidably mounted to the machine and which may slid forwardly toward the operator. Access to components within that section or module may thus be accessed. These sections or modules are mounted on ways or guides.

To provide for smooth, even motion of the tray or module as it is slid horizontally forwardly, the trays are mounted to the frame of the machine through the use of a roller slide assembly. An assembly of rollers is mounted either to the frame or to the tray and a roller race or way is formed on the either the tray or frame to permit smooth, easy opening of the tray or module.

Typical prior art roller and module slides consist of a body or housing to which a series of balls are attached. The ball and frame assembly is mounted typically to the tray and a combination of upper and roller ball tracks or races are formed in the frame of the machine. These metal ball bearing type slides are expensive. Further, the metal ball type slide mechanisms are difficult to assemble. Also, the small size of the balls may permit the balls to escape from the race which may cause the slide mechanism to slip from its track.

The following disclosures may be relevant to various aspects of the present invention:

U.S. Pat. No. 5,715,500

Inventor: Nakazato et al.

Issue Date: Feb. 3, 1998

U.S. Pat. No. 5,250,993

Inventor: Seyfried et al.

Issue Date: Oct. 5, 1993

U.S. Pat. No. 5,157,448

Inventor: Lang

Issue Date: Oct. 20, 1992

U.S. Pat. No. 5,152,517

Inventor: Ruch et al.

Issue Date: Oct. 6, 1992

U.S. Pat. No. 4,990,966

Inventor: Sindo

Issue Date: Feb. 5, 1991

U.S. Pat. No. 4,876,606

Inventor: Banno et al.

Issue Date: Oct. 24, 1989

U.S. Pat. No. 4,378,154

Inventor: Hoffman

Issue Date: Mar. 29, 1983

U.S. Pat. No. 4,332,458

Inventor: Hoffman

Issue Date: Jun. 1, 1982

The relevant portions of the foregoing disclosures may be briefly summarized as follows:

U.S. Pat. No. 5,715,500 discloses an image forming apparatus with an ADF (Automatic Document Feeder), a conveyor mechanism sequentially conveys documents from a document feeding section to a document collecting section by way of a slit for scanning the documents. The feeding section and collecting section are disposed one above the other. The ADF including the feeding section and collecting section can be bodily pulled out toward the operator away from a scanner including a CCD (Charge Coupled Device) image sensor, lens, and light source.

U.S. Pat. No. 5,250,993 discloses an apparatus for supplying toner material to a developer unit of an electrophotographic system that is mounted within a drawer and pivotable within the drawer about a longitudinal pivot axis between an active position and a non-active position includes a pivot stack connected to the developer unit at its lower end, pivoting within the developer unit about the pivot axis, the pivot stack, and having a toner passage therethrough. The apparatus also includes means for retaining the upper end of the pivot stack in a position fixed with respect to the pivot axis and means for sealing the lower end of the toner stack to the developer unit to prevent leakage of toner. The apparatus can also include a mount fixed with respect to a chassis of the system and connected to the outlet end of a toner conduit coupled to the toner reservoir, means for releasably engaging the upper end of the pivot stack that is supported on the mount for limited movement perpendicular to the longitudinal axis, and a first passage connecting the outlet end of the conduit and having an outlet end with the pivot stack when the developer unit is in the operative position, and means for sealing the outlet end of the first passage when the developer unit is in the service position.

U.S. Pat. No. 5,157,448 discloses a reproduction machine paper loading drawer interlock system which provides protection from jams by preventing drawer opening during sheet feeding therefrom, yet provides more frequent and/or rapid drawer access for copy paper loading, particularly desirable for loading one drawer while running the machine and feeding sheets from another drawer, by independently operating each paper drawer interlock from the existing wiring and electrical signals for the paper feeder drive for that drawer, without any wiring or unique software requirements from the machine controller, or requiring any machine "cycle out" signals therefrom, or actuation of any manually actuated unlocking switches.

U.S. Pat. No. 5,152,517 discloses a paper handling apparatus includes a plurality of paper receiving trays arranged vertically in close proximity to one another with a single paper feeding mechanism provided to operate with all of the trays. The paper feeding mechanism moves vertically to selectively engage any selected one of the plurality of trays. The vertical arrangement of the trays dictates that the trays are horizontally movable between a first unselected position, where the trays are substantially vertically aligned with the one another, and a second selected position where the tray is horizontally moved to intersect the vertical path of the paper feeding mechanism. Horizontal movement of the trays is effected by a single electric motor rotatably attached to a shaft, which carries a series of gears that interact with a corresponding rack disposed on each of the trays. A transmission links the motor to the gears to selectively drive one of the gears and move one of the trays between the selected and unselected positions.

U.S. Pat. No. 4,990,966 discloses an image forming apparatus having a photoconductive element for forming a toner image by an electrophotographic process thereon, and transporting a paper sheet to which the toner image has been transferred from the photoconductive element along a paper transport path which extends from a paper feeding section to a paper discharging section via an image transferring section and an image fixing section. Various process units arranged along the paper transport path are divided into a paper feeding section and a transport unit which is located downstream of the paper feeding section and includes a transferring device, a fixing device and a paper transporting device. The paper feeding section is pulled out sideways from the apparatus body in a direction opposite to the direction of paper transport and pushed into the apparatus body in the direction of paper transport. The transport unit is pulled out of the apparatus body frontward perpendicularly to the intended direction of paper transport pushed into the apparatus body in the opposite direction.

U.S. Pat. No. 4,876,606 discloses an image forming system comprises one or a plurality of image forming apparatuses and a host system coupled thereto. Each image forming apparatus is provided with a control part for reading out status information on the image forming apparatus at an arbitrary time. The obtained status information may be displayed or printed at the image forming apparatus and/or supplied to the host system.

U.S. Pat. No. 4,378,154 discloses a compact, table top plain paper copy machine has a teardrop shaped photoreceptor belt. A reciprocating carriage scan exposes an original document to the photoreceptor through an optical system having a Z-shaped optical path. The optical system and a number of other processing stations are located directly underneath the carriage thereby contributing to the overall compactness of the machine. A pair of pressure fusing rollers fix a dry toned image to a plain paper copy sheet, so that no energy is required to maintain the machine in a warm-up or stand-by mode of operation.

U.S. Pat. No. 4,4,332,458 discloses a compact, table top plain paper copy machine has a teardrop shaped photoreceptor belt. A reciprocating carriage scan exposes an original document to the photoreceptor through an optical system having a Z-shaped optical path. The optical system and a number of other processing stations are located directly underneath the carriage thereby contributing to the overall compactness of the machine. A pair of pressure fusing rollers fix a dry toned image to a plain paper copy sheet, so that no energy is required to maintain the machine in a warm-up or stand-by mode of operation.

In accordance with one aspect of the present invention, there is provided a slide mechanism for mounting a sliding member to a housing. The mechanism includes a body having first and second opposed surfaces. The sliding member is mountable to the body. The mechanism also includes a plurality of journals extending from the body. Each of the plurality of journals has a central axis thereof. The mechanism also includes a plurality of rollers. Each of the plurality of rollers is rotatably fitted to one of the plurality of journals. The plurality of rollers is operably connectable to the housing. At least one of the body and the plurality of journals are molded from a moldable material.

Pursuant to another aspect of the present invention, there is provided a slide mechanism for mounting a sliding member to a housing. The mechanism includes a body having first and second opposed surfaces. The sliding member is mountable to the body. The mechanism further includes a plurality of journals extending from the first surface of the body. Each of the plurality of journals has a central axis thereof. The plurality of journals includes a first set of journals. The centerlines of the first set of journals are coplanar to each other. The centerlines of the first set of journals define a first plane. The plurality of journals also includes a second set of journals. The centerlines of the second set of journals are coplanar to each other. The centerlines of the second set of journals define a second plane spaced from and parallel to the first plane. The mechanism further includes a member securable to the housing and a plurality of rollers. Each of the plurality of rollers is rotatably fitted to one of the plurality of journals. The plurality of rollers are slidably fittable to the member. The body includes a resilient feature which provides for relative motion of at least one of the journals of the first set of journals with respect to at least one of the journals of the second set of journals.

Pursuant to yet another aspect of the present invention, there is provided an electrophotographic printing machine having a slide mechanism for mounting a sliding member to a housing. The mechanism includes a body having first and second opposed surfaces. The sliding member is mountable to the body. The mechanism also includes a plurality of journals extending from the body. Each of the plurality of journals has a central axis thereof. The mechanism also includes a plurality of rollers. Each of the plurality of rollers is rotatably fitted to one of the plurality of journals. The plurality of rollers is operably connectable to the housing. At least one of the body and the plurality of journals are molded from a moldable material.

Other features of the present invention will become apparent as the following description proceeds and upon reference to the drawings, in which.

Figure 1:
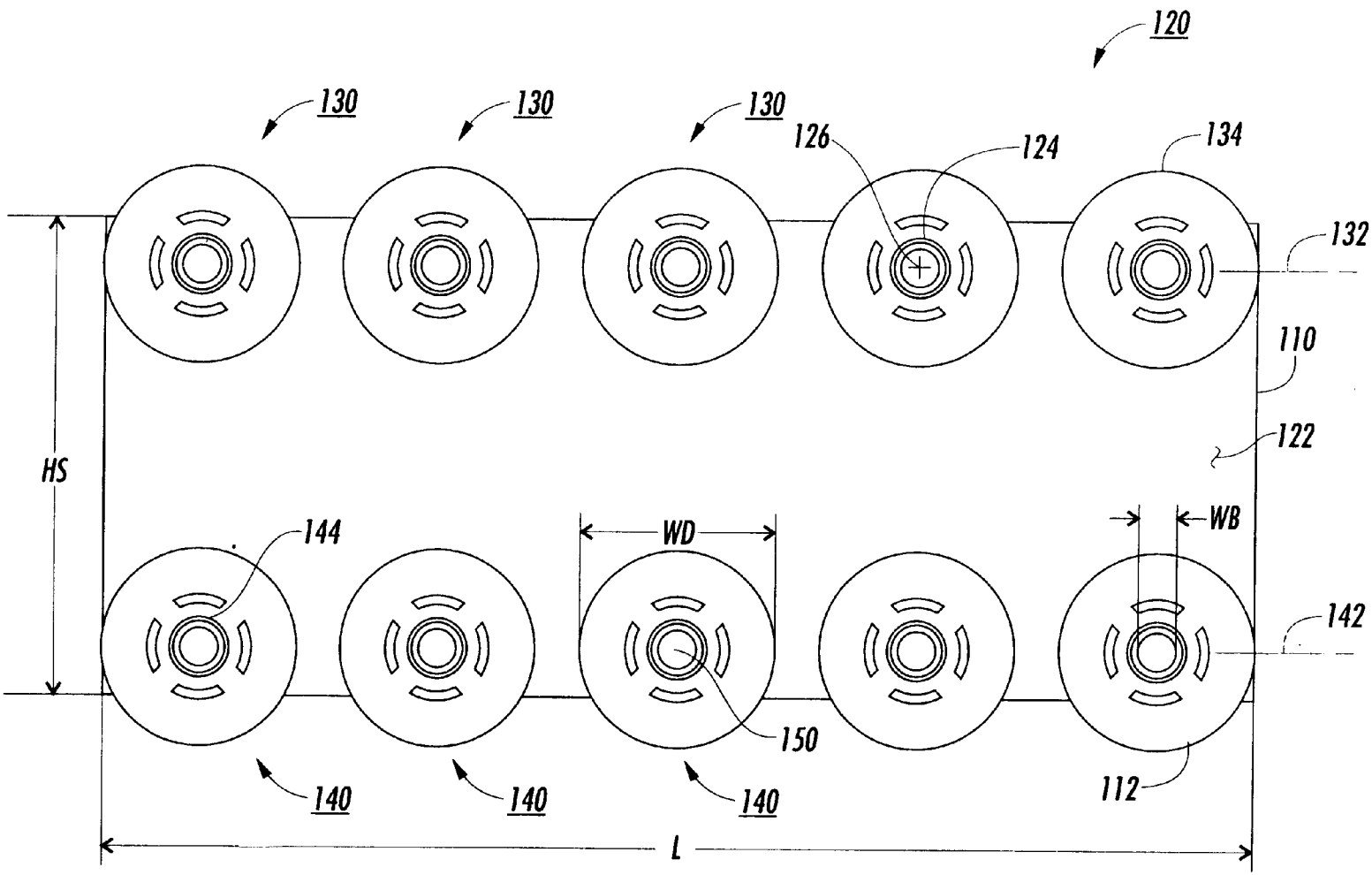
FIG. 1 is an plan view of a molded roller slide mechanism according to the present invention.

While the present invention will be described in connection with a preferred embodiment thereof, it will be understood that it is not intended to limit the invention to that embodiment. On the contrary, it is intended to cover all alternatives, modifications, and equivalents as may be included within the spirit and scope of the invention as defined by the appended claims.

For a general understanding of the features of the present invention, reference is made to the drawings. In the drawings, like reference numerals have been used throughout to identify identical elements.

Figure 2:
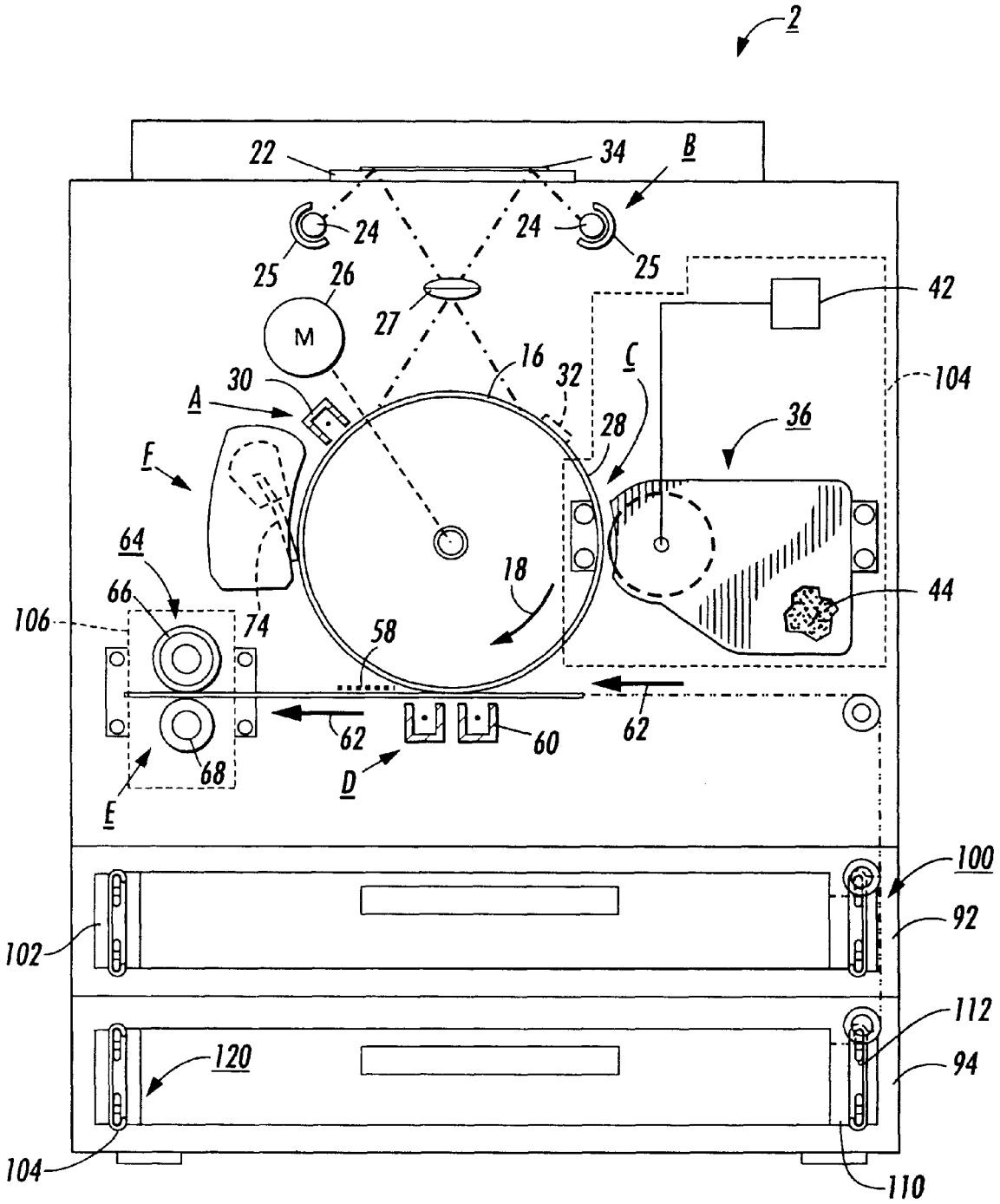
FIG. 2 is a schematic elevational view of an electrophotographic printing machine including a sorting device incorporating the FIG. 1 guard therein.

Referring now to FIG. 2, the electrophotographic printing machine shown employs a photoconductive drum 16, although photoreceptors in the form of a belt are also known, and may be substituted therefor. The drum 16 has a photoconductive surface deposited on a conductive substrate. Drum 16 moves in the direction of arrow 18 to advance successive portions thereof sequentially through the various processing stations disposed about the path of movement thereof. Motor 26 rotates drum 16 to advance drum 16 in the direction of arrow 18. Drum 16 is coupled to motor 26, by suitable means such as a drive.

Initially successive portions of drum 16 pass through charging station A. At charging station A, a corona generating device, indicated generally by the reference numeral 30, charges the drum 16 to a selectively high uniform electrical potential. The electrical potential is normally opposite in sign to the charge of the toner. Depending on the toner chemical composition, the potential may be positive or negative. Any suitable control, well known in the art, may be employed for controlling the corona generating device 30.

A document 34 to be reproduced is placed on a platen 22, located at imaging station B, where it is illuminated in a known manner by a light source such as a lamp 24 with a photo spectral output matching the photo spectral sensitivity of the photoconductor. The document thus exposed is imaged onto the drum 16 by a system of mirrors 25 and lens 27, as shown. The optical image selectively discharges surface 28 of the drum 16 in an image configuration whereby an electrostatic latent image 32 of the original document is recorded on the drum 16 at the imaging station B.

At development station C, a development system or unit, indicated generally by the reference numeral 36 advances developer materials into contact with the electrostatic latent images. The developer unit includes a device to advance developer material into contact with the latent image.

The developer unit 36, in the direction of movement of drum 16 as indicated by arrow 18, develops the charged image areas of the photoconductive surface. This developer unit contains, for example, black developer material 44 having a triboelectric charge such that the black toner is attracted to charged areas of the latent image by the electrostatic field existing between the photoconductive surface and the electrically biased developer rolls in the developer unit, which are connected to bias power supply 42, attracts the toner to the latent image.

A sheet of support material 58 is moved into contact with the toner image at transfer station D. The sheet of support material 58 is advanced to transfer station D by conventional sheet feeding apparatus, not shown. Preferably, the sheet feeding apparatus includes a feed roll contacting the uppermost sheet of a stack of copy sheets. Feed rolls rotate so as to advance the uppermost sheet from the stack into a chute which directs the advancing sheet of support material into contact with the photoconductive surface of drum 16 in a timed sequence so that the toner powder image developed thereon contacts the advancing sheet of support material at transfer station D.

Transfer station D includes a corona generating device 60 which sprays ions of a suitable polarity onto the backside of sheet 58. This attracts the toner powder image from the drum 16 to sheet 58. After transfer, the sheet continues to move, in the direction of arrow 62, onto a conveyor (not shown) which advances the sheet to fusing station E.

Fusing station E includes a fuser assembly, indicated generally by the reference numeral 64, which permanently affixes the transferred powder image to sheet 58. Preferably, fuser assembly 64 comprises a heated fuser roller 66 and a pressure roller 68. Sheet 58 passes between fuser roller 66 and pressure roller 68 with the toner powder image contacting fuser roller 66. In this manner, the toner powder image is permanently affixed to sheet 58. After fusing, a chute, not shown, guides the advancing sheet 58 to a catch tray, also not shown, for subsequent removal from the printing machine by the operator. It will also be understood that other post-fusing operations can be included, for example, binding, inverting and returning the sheet for duplexing and the like.

After the sheet of support material is separated from the photoconductive surface of drum 16, the residual toner particles carried by image and the non-image areas on the photoconductive surface are removed at cleaning station F. The cleaning station F includes a blade 74.

According to the present invention and referring again to FIG. 2, a slide mechanism 100 is shown attached to upper tray 92 of the copy machine 2. In fact, upper tray 92 utilizes slide mechanism 100 on both the left and right-hand side of the upper tray 92. In addition to the utilization of the sliding mechanism 100 on upper tray 92, the slide mechanism 100 is utilized on both the left and right-hand side of lower tray 94.

It should be appreciated that the slide mechanism 100 of the present invention may be well suited for any portion of the printing machine 2 which is slidably mounted to frame 102 of the machine 2. For example, as shown in FIG. 2, the machine 2 includes development module 104 to which the developer unit 36 is slidably attached. The development module 104 also preferably includes the slide mechanism 100.

Further, as shown in FIG. 2, the copy machine 2 includes fuser module 106 preferably includes slide mechanisms 100 both on the left and the right side of the fuser module 106.

The slide mechanism 100 preferably includes a body 110 to which a plurality of rollers 112 are rotatably attached. The rollers 112 are operably secured to frame 102 of the machine 2 in any suitable fashion. For example, the rollers 112 may be rollably secured to a member 114 in the form of a track 104. The track 104 is fixably secured to the frame 102. The body 110 of the slide mechanism 100 may be fixably secured to the tray 92. The body 110 and the rollers 112 form roller assembly 120.

Referring now to FIG. 1, roller assembly 120 is shown in greater detail. The roller assembly 120 includes the body 110. The body 110 has any suitable shape capable of supporting the rollers 112. For example, the body 110 may include a first surface 122. A plurality of journals 124 extend from the first surface 122 of the body 110. The rollers 112 may be fixedly secured to Journals 124, but are preferably rotatably secured to journals 124. The rollers 112 rotate about central axis 126 of the journals 124.

Preferably the roller assembly 120 includes a first set 130 of journals 124. The central axis 126 of the first set 130 of journals 124 are preferably coplanar to each other. The central axis 126 of the first set 130 of journals 126 define a first plane 132. Preferably, periphery 134 of the rollers 112 extend past the body 110 to assure that the periphery 134 of the rollers 112 may satisfactorily mate with the frame 102 (see FIG. 2).

Preferably, in addition to the first set 132 of journals 124, the roller assembly 120 further includes a second set 140 of journals 126. The second set 140 of journals 126 are similar to the first set 130 of journals 124 include central axis 126 which are coplanar to each other. The central axis 126 of the second set 140 of journals 126 define a second plane 142 spaced from and parallel to the first plane 132.

The body 110 may have any suitable shape and may, for example for simplicity, be as shown in FIG. 1 in the form of a rectangularly shaped plate having a length L and a height HS. The body 110 may, for example, have a second surface 143 spaced from and parallel to first surface 122. The body 110 may be defined by a thickness T (see FIG. 3), The body 110 may be made of any suitable durable material, for example, a metal or a plastic. The bopolyamide, polyoxymethylenlon, a polyamide, polyoxymethylene or acetal, for example, Delrin® (a product of E.I. duPont).

Figure 3:
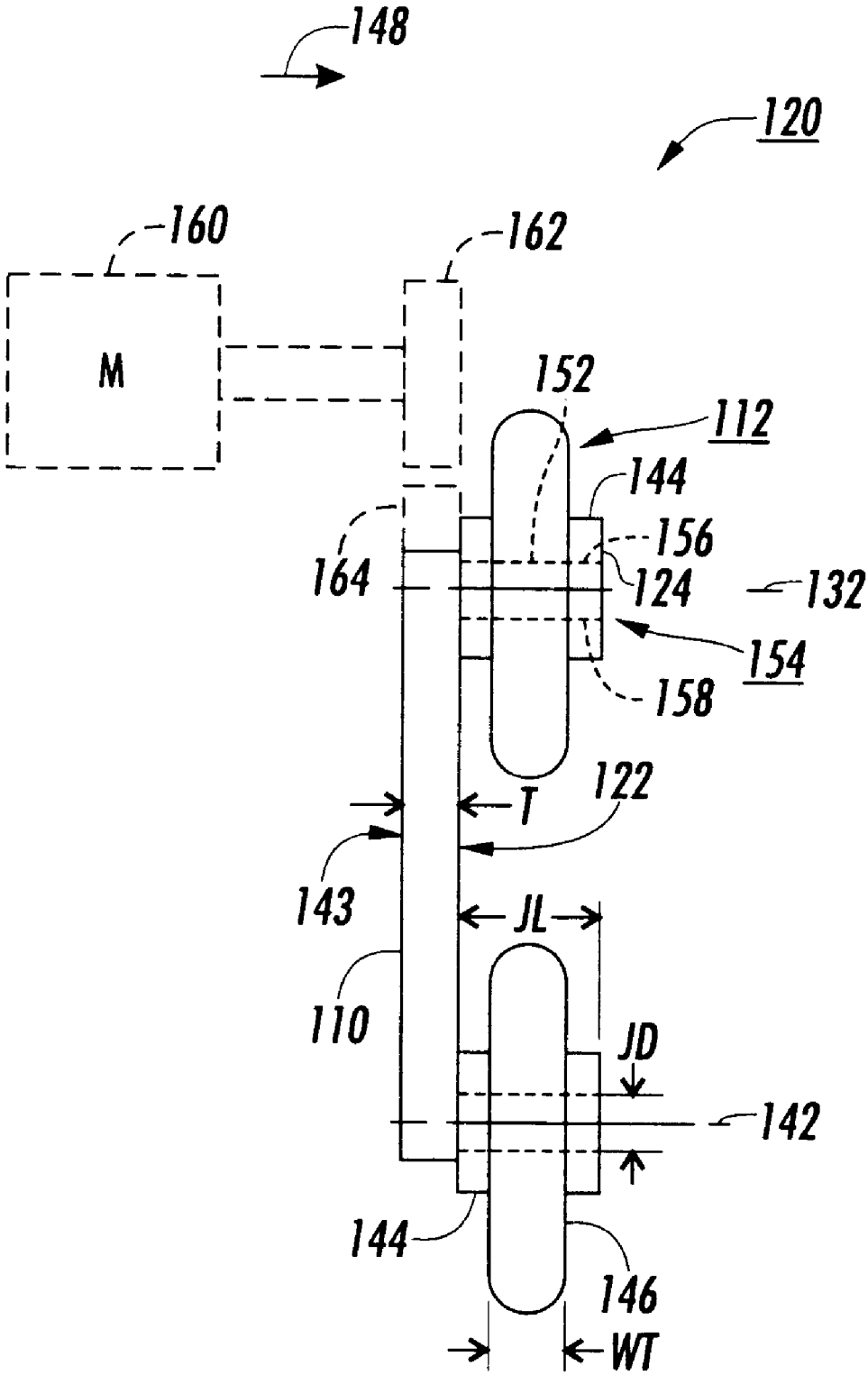
FIG. 3 is an end view of the FIG. 1 slide mechanism.

The journals 124 may have any suitable size and shape capable of adequately supporting the rollers 112, but preferably to permit the rotation thereof, the rollers 112 have a cylindrical shape including a diameter DJ and a length JL (see FIG. 3). The journals 124 may be made of any suitable durable material, for example, a metal or a plastic and are preferably made of a nylon, a polyamide, polyoxymethylene or acetal, for example, Delrin®. The journals 124 and the body 110 may be made from different materials and assembled together by any assembly technique, such as, by gluing, interference fit or welding. Preferably, however, the journals 124 are integrally formed with a one-piece construction with the body 110. For example, if made from a plastic or any other moldable material, the journals 126 and the body 110 are preferably integrally molded together.

The rollers 112 may have any suitable shape capable of rollably supporting the roller assembly 120. For example, the rollers 112 may have a generally cylindrical shape with a periphery 134 defined by diameter WD and a width defined by WT. Preferably, the rollers 112 include hubs 144 extending from faces 146 of the rollers 112. The hubs 144 provide clearance between the faces 146 of the roller 112 and first face 122 of the body 110.

The rollers 112 are secured to the journals 124 in any suitable fashion. Preferably, the rollers 112 includes a central bore 150 defined by diameter WB. An outer periphery 152 of the journal 124 is rotatably fitted to the bore 150 of the rollers 112. Periphery 152 of the journal 124 is defined by the journal diameter JD which is slightly smaller than the diameter WB of the bore 150 of the roller 112.

While it should be appreciated that the roller assembly 120 may operate satisfactorily if the are permitted to freely travel in the direction of arrow 148. In such a configuration other components may be used to prevent the inadvertent removal of the roller 112 from the journal 124. Preferably, however, at least one of the roller 112 and journal 124 includes a retaining feature 154 for retaining the roller 112 on the journal 124. For example, the retaining feature 154 may be in the form of a protrusion 156 extending from journal 124 which mates with a recess 158 on hub 144 of the roller 112.

The rollers 112 may be made of any suitable durable material for example, a metal or a plastic. Preferably, however, the rollers 112 are made of a plastic, for example, nylon or acetal.

Referring again to FIG. 2, the trays 92 and 94 and the modules 104 and 106 of the machine 2 may be freely slidable in the direction of the operator. However, it should be appreciated that the machine 2 may control the motion of the trays 92 and 94 and the modules 104 and 106. For example, a motor may be used to operate the motion of the trays 92 and 94 and the modules 104 and 106.

For example, referring now to FIG. 3, the roller assembly 120 may be operably connected to a motor 160 as shown in phantom. The motor 160 may be operably connected to the roller assembly 120 in any suitable fashion, such as by a pinion gear 162 directly mounted to the motor 160. The pinion 162 may mesh with a rack 164 secured to, for example, body 110 of the roller assembly 120. The rack 164 may be separable component or preferably, be integrally molded with body 110, as shown in phantom in FIG. 3.

Figure 4:
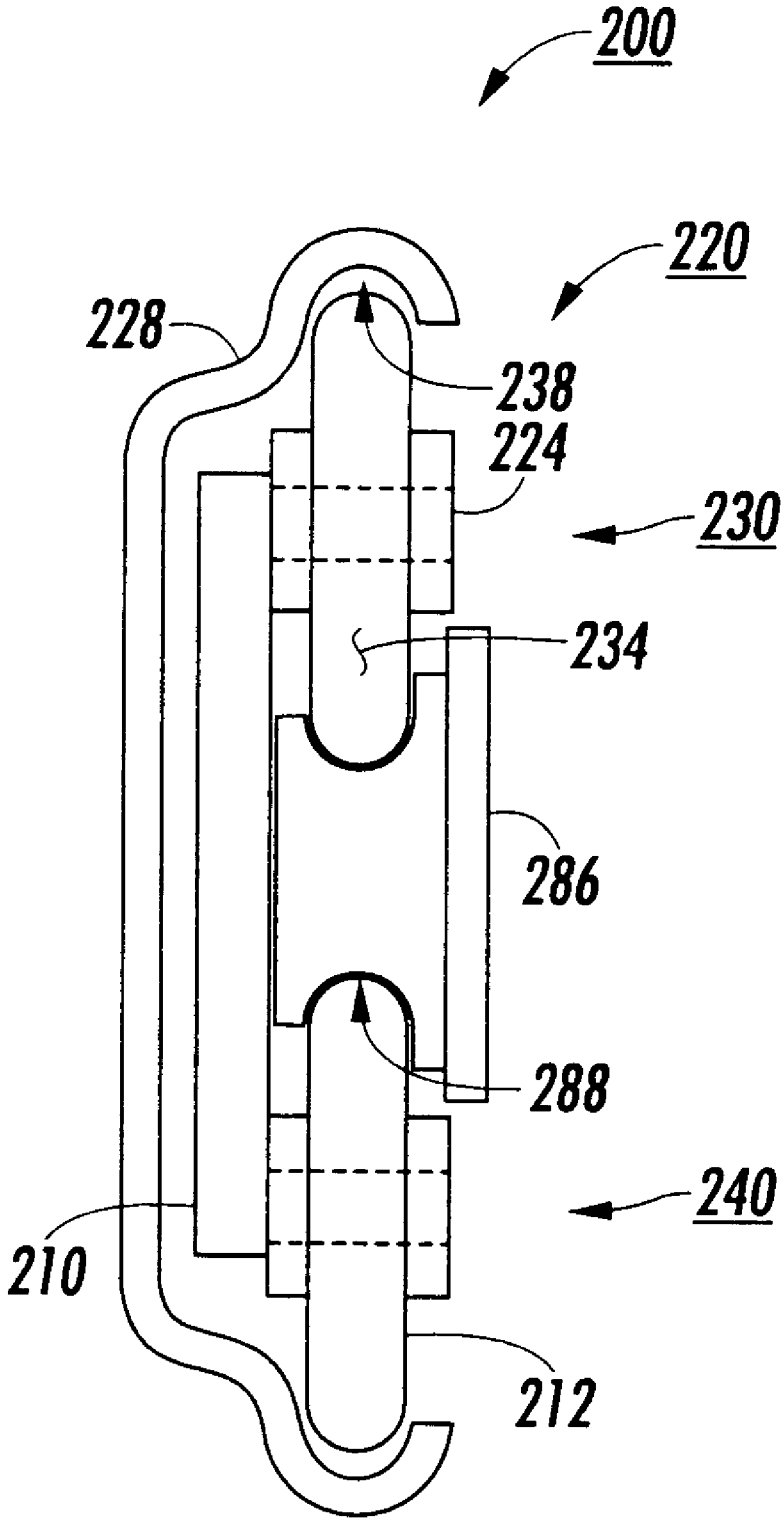
FIG. 4 is an end view of a first alternative embodiment of the present invention utilizing the FIG. 5 rail and the FIG. 6 track.

Referring now to FIG. 4, an alternate embodiment of a slide mechanism according to the present invention is shown as slide mechanism 200. Slide mechanism 200 is similar to slide mechanism 100 of FIG. 1, except that slide mechanism 200 further includes a rail 286 which is used to support the rollers 212. The slide mechanism 200 includes a body 210 similar to body 110 of the slide mechanism 100 except that body 210 is not utilized to secure the paper tray thereto.

In the slide mechanism 200 of FIG. 4, the rail 286 is utilized to secure the tray thereto. The body 210 further includes journals 224 which are similar to journals 124 of the slide mechanism 100. The rollers 212 are similar to rollers 112 of the slide mechanism 100 and are rotatably secured to journals 224.

Roller periphery 234 is in contact with track race 238 of track 228. Track 228 is preferably fixedly mounted to the frame of the copy machine. The track 228 is made of any suitable durable material and is preferably made of a metal, for example carbon steel. The track 228 may be formed from sheet steel. Roller assembly 220, which includes the rollers 212, body 210 and the journals 224, is slidably secured to the track 228. For example, the roller periphery 234 rollably contacts the race 238 of the track 228.

To prevent the journals 224 in the first set 230 of journals 224 from bowing away from the journals 224 in the second set 240 of journals 224, the rail 286 is positioned between the first set 230 and the second set 240 of journals 224. The rail 286 includes a rail race 288 which is in rolling contact with roller periphery 234 of the rollers 212.

Figure 5:
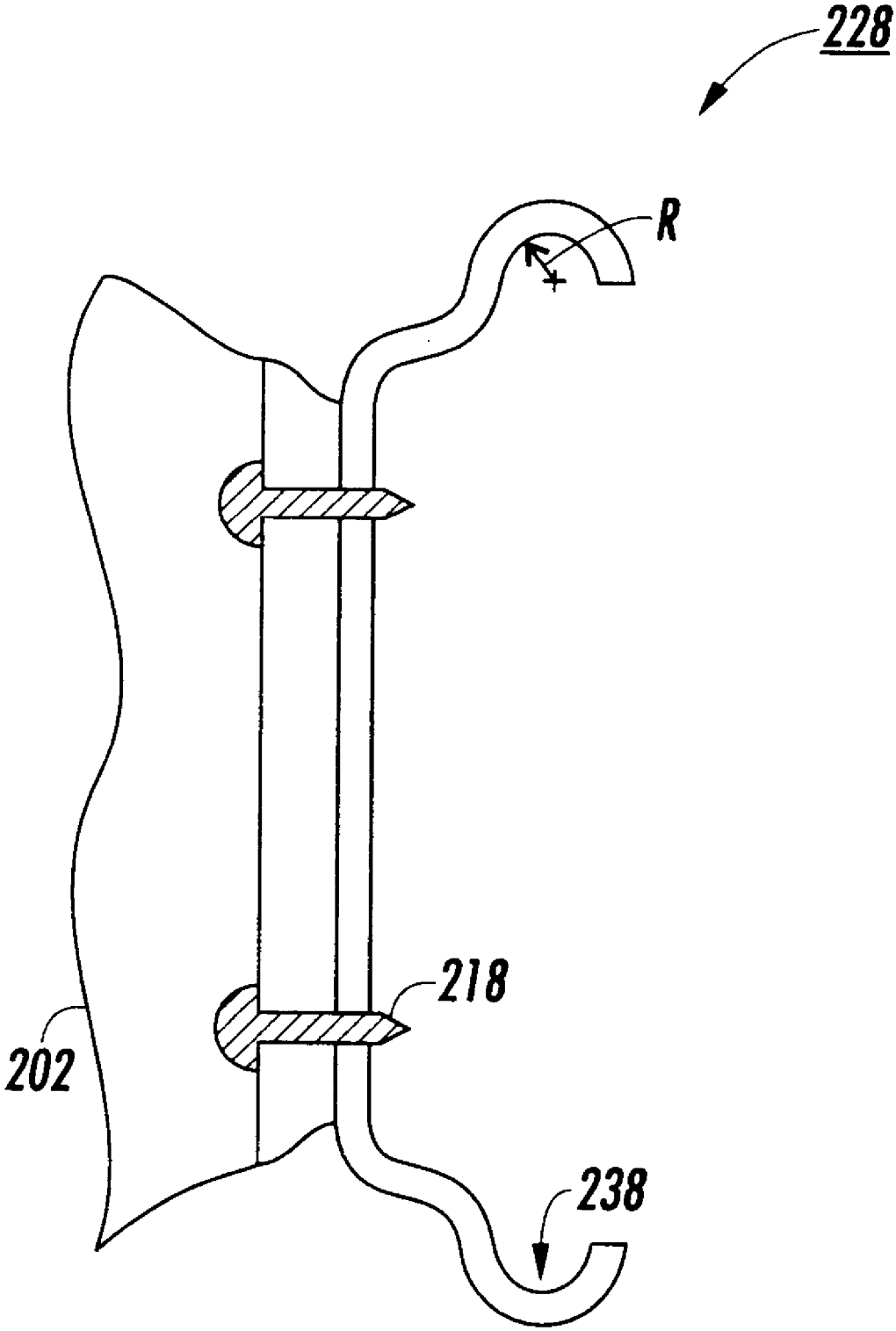
FIG. 5 is an enlarged end view of a rail for supporting the FIG. 4 slide mechanism.

Referring now to FIG. 5, the track 228 is shown in greater detail. The track 228 includes the race 238 to which the rollers 212 (see FIG. 4) are rollably engaged. The race 238 is defined by a radius R and preferably has a circular arcuate shape. The track 228 may be secured to frame 202 in any suitable fashion, for example by fasteners 218.

Figure 6:
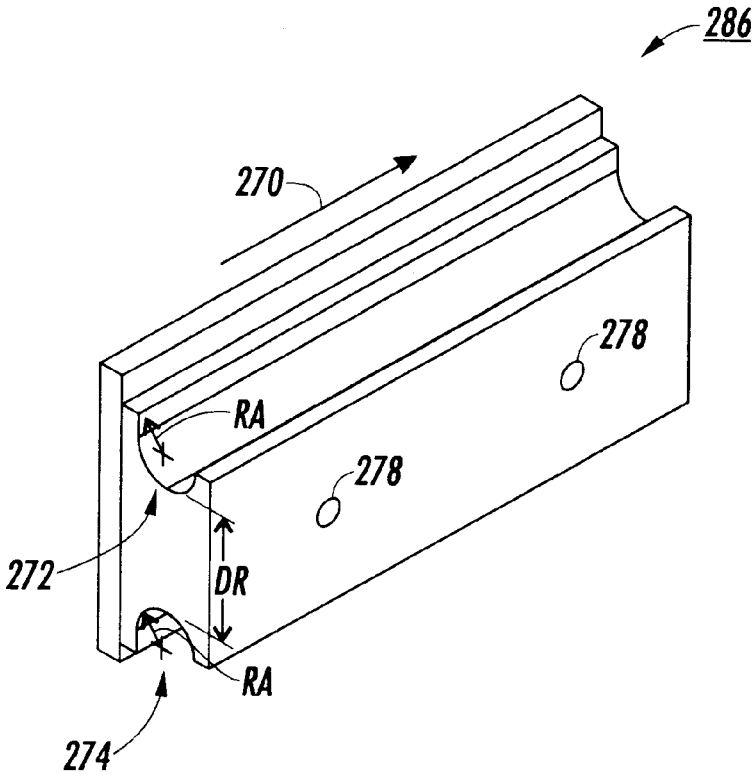
FIG. 6 is a perspective view of the support track for use with the FIG. 4 slide mechanism.

Referring now to FIG. 6, the rail 286 is shown in greater detail. The rail 286, preferably, has a uniform cross-section and extends substantially in the direction of arrow 270. The rail 286 includes an upper race 272 and a lower race 274. The upper race 272 is in contact with first set 230 of rollers 212 and the lower race 274 is in contact with the rollers 212 in the second set 240 of rollers 212 (see FIG. 4). The upper race 272 and the lower race 274 are separated by a distance, for example DR. The upper race and lower race 272 and 274 are defined by a race radius RA.

The race 272 and 274 are matingly fitted to the periphery 234 of the rollers 212 (see FIG. 4). The rail 286 may be secured to the tray in any suitable fashion, for example by fasteners (not shown) which may pass through the tray (not shown) and be threadably secured to threaded holes 278 in rail 286.

Figure 7:
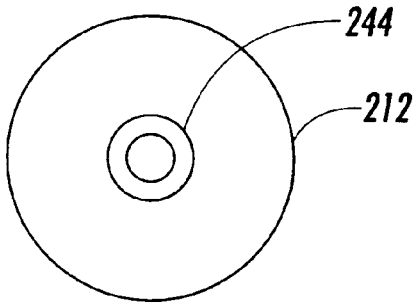
FIG. 7 is a plan view of a roller for use in the FIG. 4 slide mechanism.

Referring now to FIG. 7, roller 212 is shown in greater detail. The roller 212 is similar to roller 112 of the slide mechanism 100 and may, for example, include hubs 244 for spacing the roller 212 from the body 212 (see FIG. 4).

Figure 8:
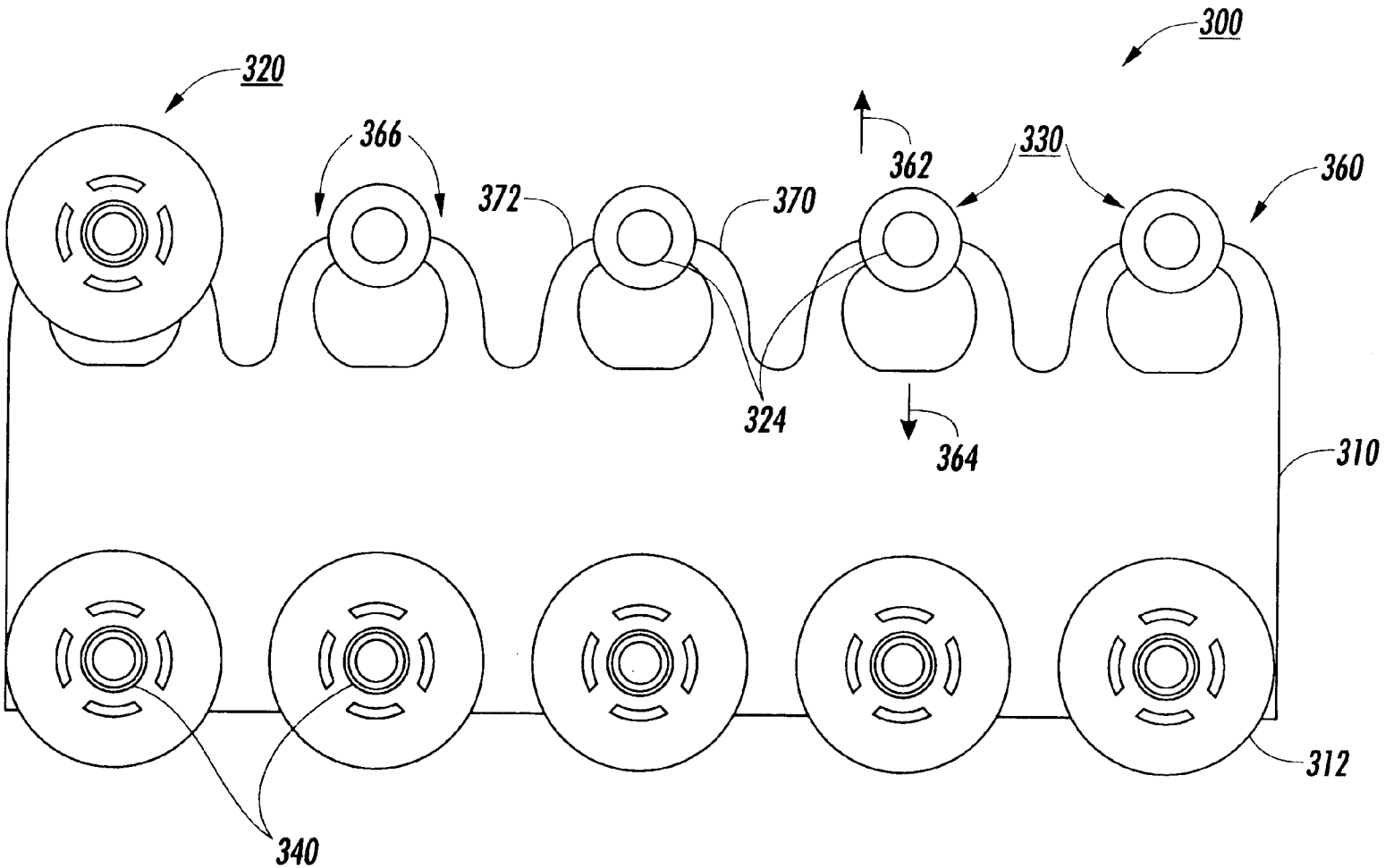
FIG. 8 is a plan view of a second alternative embodiment of a molded roller slide mechanism of the present invention including a set of molded springs.

Referring now to FIG. 8, an alternate embodiment of the slide mechanism of the present invention is shown as slide mechanism 300. Slide mechanism 300 includes roller assembly 320. The roller assembly 320 includes a body 310, a plurality of journals 324 which are secured to the body 310, and a plurality of rollers 312 which are rotatably fitted to the journals 324.

The rollers 312 are similar to the rollers 310 of the roller assembly 120 and the journals 324 are similar to the journals 124 of the roller assembly 120.

The body 310 is similar to the body 110 of the roller assembly 120 except that the body 310 further includes a resilient feature 360 for urging the journals 324 in the direction of arrows 362 in the direction away from the body 310 when the journals 324 have been compressed or distorted in the direction of arrow 364 in the direction toward the body 310.

The resilient feature 360 as shown in the slide mechanism 300 of FIG. 8, is associated with first set 330 of journals 324 and is not included in second set 340 of journals 324. While it should be appreciated that the resilient feature 360 may be made from a separate component from the body 310 and secured thereto, preferably, the resilient feature 360 is integral and of a one piece construction with the body 310.

The resilient feature 360 may have any suitable shape and configuration but preferably is in the form of a series of sets 366 of spacedapart arms. Each set 366 of arms includes a first arm 370 and a second arm 372. The first arm 370 is spaced from the second arm 372 and both the first arm 370 and the second arm 372 extend from body 310 toward journal 324. Preferably, the first arm 370 and second arm 372 have a curved or arcuate shape to enhance the ability of the set 366 of arms to be pliable or resilient in the direction of arrows 362 and 364.

Figure 9:
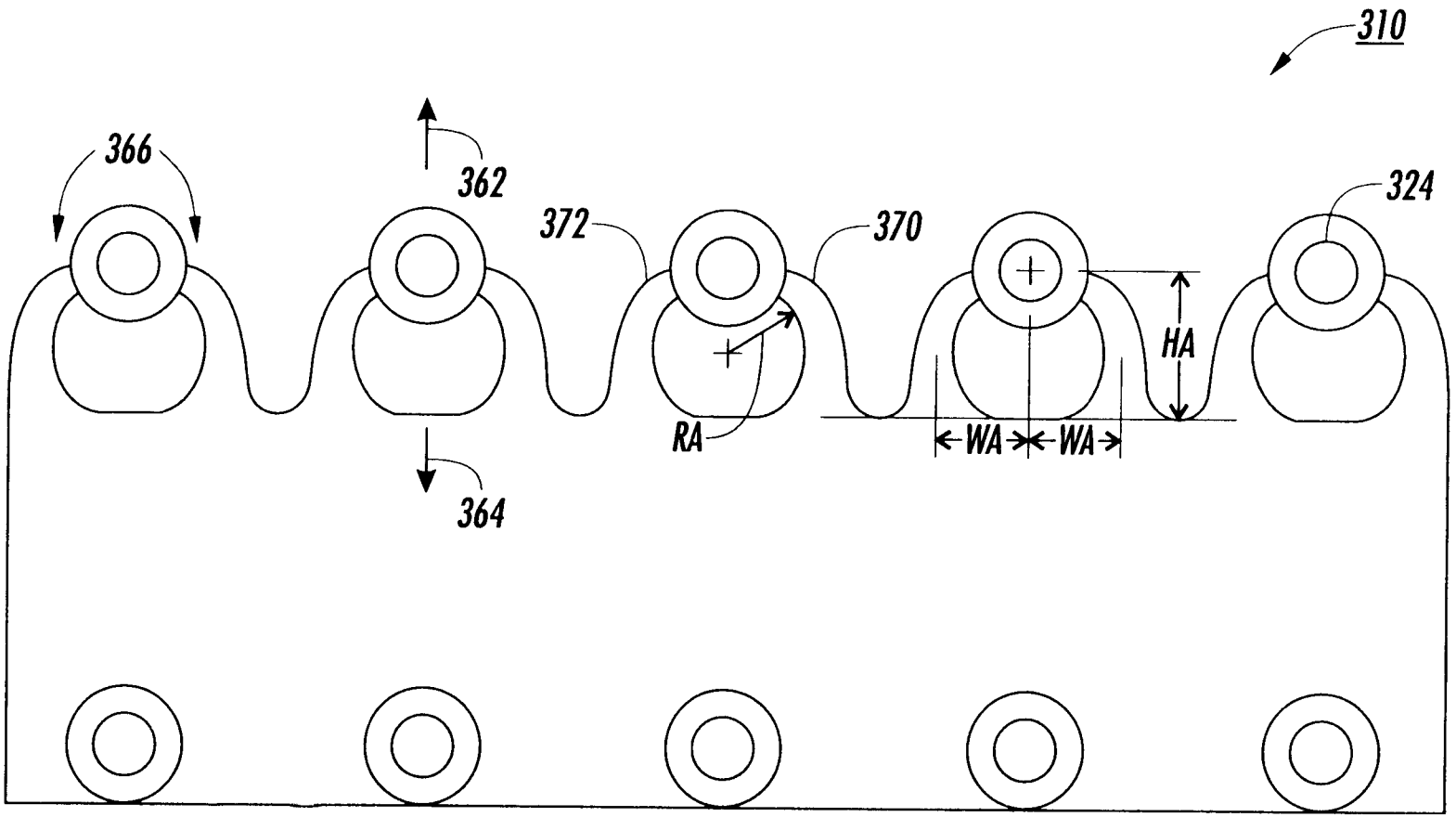
FIG. 9 is a plan view of a roller slide body for use in the FIG. 8 slide mechanism.

Referring now to FIG. 9, the body 310 is shown in greater detail. As shown in FIG. 9, the body 310 include five sets 366 of spaced-apart arms but it should be appreciated that a smaller or larger number of sets 366 of arms may be suitable for the proper application of the invention. The first arms 370 and the second arm 372 preferably have symmetrical shapes to provide for proper motion in the direction of arrows 364 and 362. For example, the arms 370 and 372 may be defined by a height HA and a width WA. Preferably, the arms 370 and 372 are arcuate and are defined by a radius RA.

While the body 310 may be made of any suitable resilient material, preferably, the body 310 is made of a plastic, for example, a nylon, a polyamide, polyoxymethylene or acetal, for example, Delrin® (a product E.I. duPont).

Figure 10:
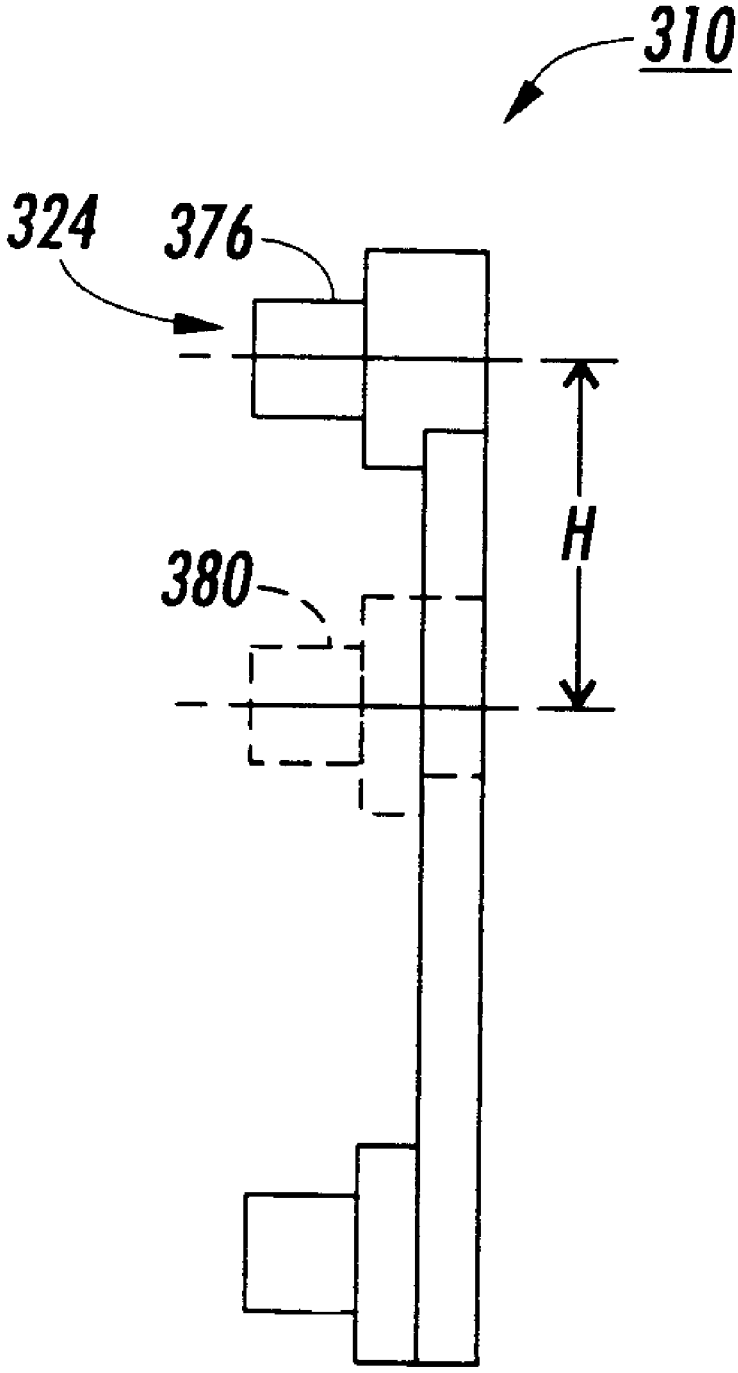
FIG. 10 is an end view of the roller slide body of FIG. 9.

Referring now to FIG. 10, an end view of the body 310 as shown. The body 310 is shown with journal 324 in a relaxed position in solid as reference numeral 376 and in the restrained position as assembled into a tray assembly as shown in phantom as reference numeral 380. The journal 324 thus has a motion in the vertical direction defined by dimension H.

Figure 11:
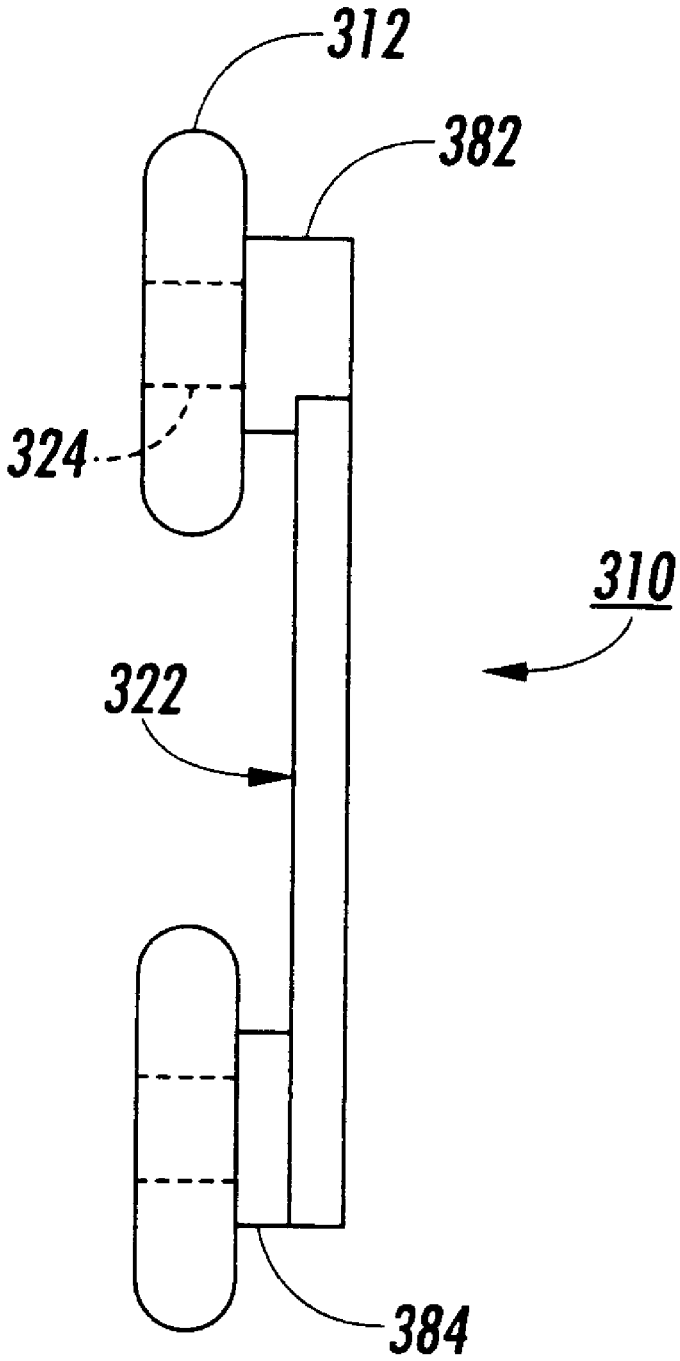
FIG. 11 is an end view of the FIG. 8 molded roller slide mechanism.

Referring now to FIG. 11, the body 310 is shown in an end view with rollers 312 assembled onto the journals 324. The rollers 312 are similar to rollers 112 of FIG. 3, except that rollers 312 do not include hubs 110 as shown in FIG. 3. Instead, alternatively, the body 310 includes spacers 382 and 384 for spacing the rollers 312 from first face 322 of the body 310.

Figure 12:
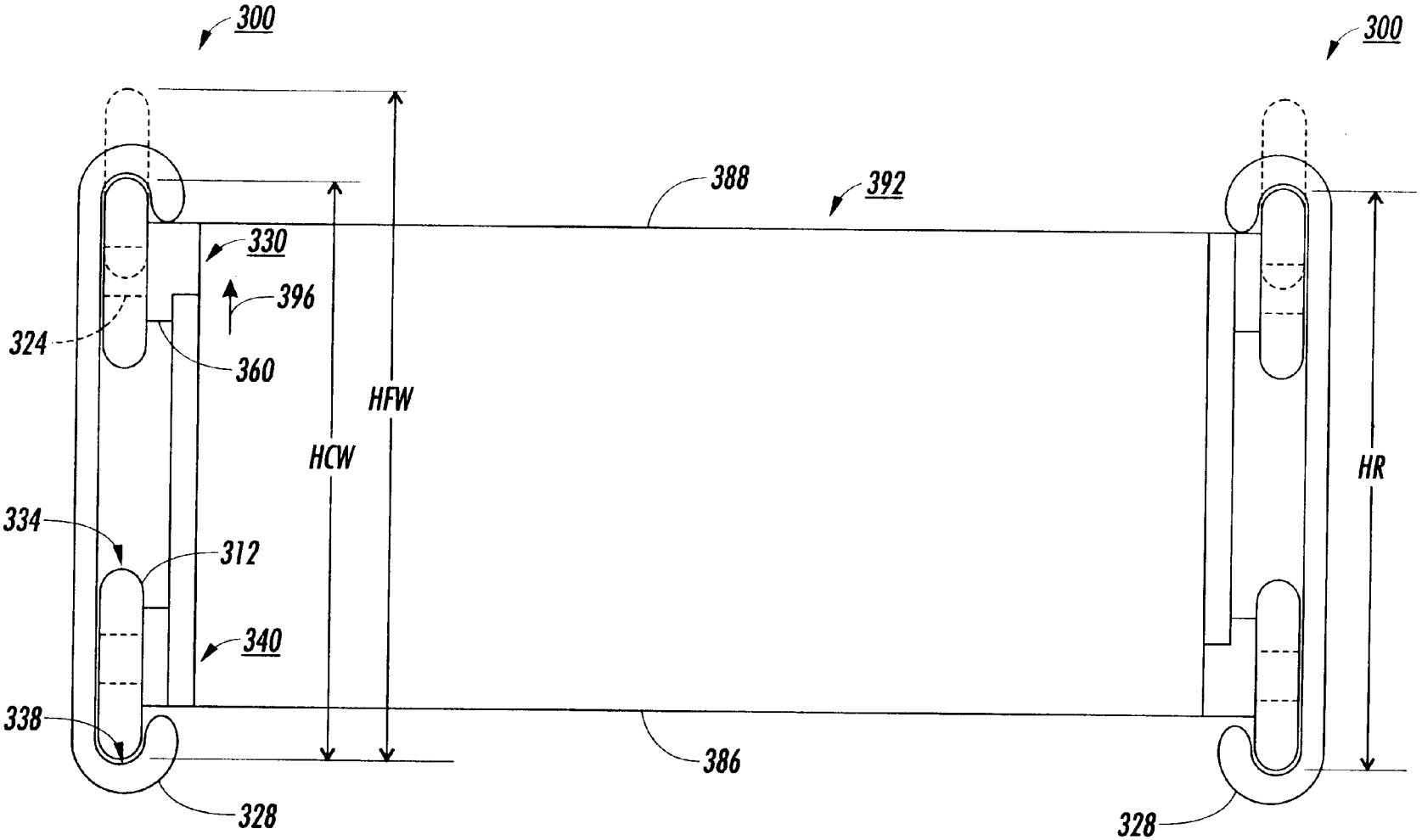
FIG. 12 is a partial end view of the slide mechanism of FIG. 8 installed into a sliding tray.

Referring now to FIG. 12, a pair of slide mechanisms 300 are shown assembled onto tray 392. Tray 392 is similar to tray 92 of FIG. 3. The slide mechanisms 300 are fitted to tracks 328. The tracks 328 include races 338 to which the rollers 312 rollably mate. Preferably, the slide mechanisms 300 are mounted such that second set 340 of the journals 324 are positioned on lower side 386 of the tray 392 so that the position of the tray 392 remains constant. The second set 330 of the journals 324 which include the resilient feature 360 are positioned near top 388 of the tray 392.

The tracks 328 are made of any suitable durable material and typically are made of a material similar to tracks 328 of slide mechanism 300 of FIG. 4. Preferably, the track 328 is made of a metal, for example, stamped steel.

Races 338 of the track 328 define a race diameter HR and the periphery 334 of the rollers 312 define a roller unrestrained diameter HFW and a roller constrained diameter HCW. The unconstrained or free diameter HFW is larger than the race diameter HR such that when the rollers 312 are brought together to obtain the restrained diameter HCW, the rollers 312 exert a force in the direction of arrows 396 to hold the rollers 312 securely against the race 338 of the track 328.

Figure 13:
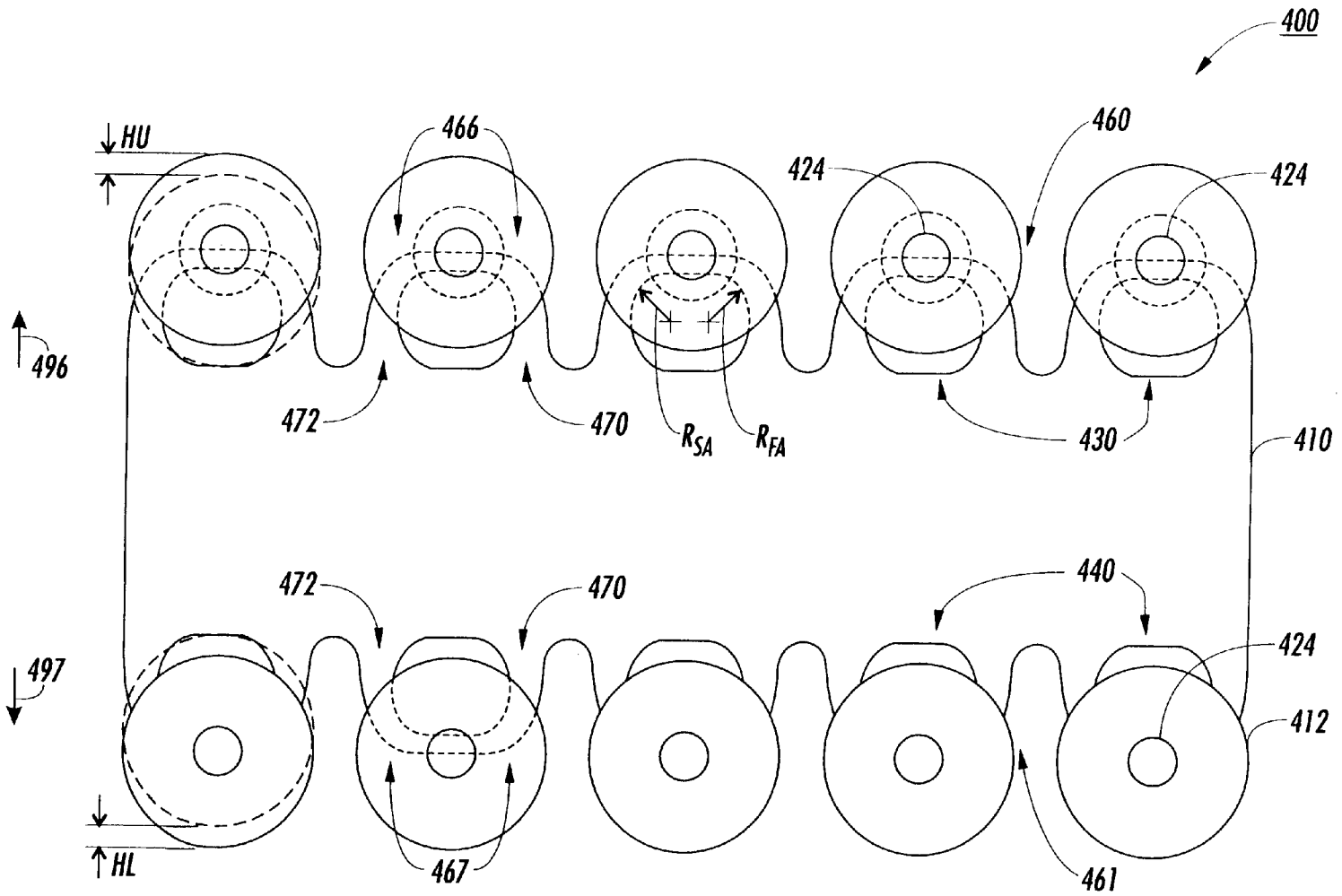
FIG. 13 is a plan view of yet another alternative embodiment of the roller slide mechanism of the present invention including two opposed sets of molded springs.

Referring now to FIG. 13, another embodiment of the present invention is shown as slide mechanism 400. Slide mechanism 400 is similar to slide mechanism 300 of FIG. 8, except that slide mechanism 400 further includes a lower resilient feature 461 in addition to upper resilient feature 460. Resilient features 460 and 461 are similar to resilient feature 360 of FIG. 8.

The slide mechanism 400 preferably includes a body 410 similar to body 310 of FIG. 8 which includes journals 424 similar to journals 324 of FIG. 8. Rotatably secured to journals 424 are rollers 412 which are similar to rollers 312 of FIG. 8.

The upper resilient feature 460 is associated with the first set 430 of journals 424 and include first set 466 of spaced-apart arms similar to set 366 of spaced-apart arms of FIG. 8. The first set 466 of arms include first arm 470 and second arm 472. First arm 470 is similar to first arm 370 of FIG. 8 and has an arcuate shape defined radius $R_{FA}$ while second arm 472 is similar to second arm 372 of FIG. 8 and has an arcuate shape defined by radius $R_{SA}$.

The lower resilient feature 461 is associated with second set 440 of journals 424 and includes second sets 467 of arms similar to first set 466 of arms and includes first arms 470 and second arms 472.

The upper resilient feature 470 is configured such that the sets 466 of arms permit the roller 412 to move in the direction of arrow 496 toward the body 410, a distance of, for example HU.

The lower resilient feature 462 includes the second sets 467 of arms which when deflected in the direction of arrow 497 permit rollers 412 to move a direction HL.

By providing a slide mechanism having moldable components an inexpensive, lightweight, and easy to assemble slide mechanism can be provided.

By providing a slide mechanism including a body with integral molded journals, an inexpensive, lightweight, and easy to assemble slide mechanism may be provided.

By providing a slide mechanism including a body made of a nylon, a polyamide, polyoxymethylene or acetal, an inexpensive lightweight yet strong slide mechanism may be provided.

By providing a slide mechanism including a first set of journals which are coplanar and a second spaced-apart of journals which are coplanar to each other, a slide mechanism may be provided including moldable body and rollers which may easily replace an existing metal ball and carrier assembly.

By providing a slide mechanism including a ball body with a resilient feature to provide relative motion between a first and a second set of rollers, a slide mechanism may be provided with more relaxed as molded or formed component tolerance and yet provide for tight, firm sliding mechanism.

It is believed that the foregoing description is sufficient for purposes of the present application to illustrate the general operation of an electrophotographic printing machine incorporating the development apparatus of the present invention therein.

It is, therefore, apparent that there has been provided in accordance with the present invention, a slide mechanism that fully satisfies the aims and advantages hereinbefore set forth. While this invention has been described in conjunction with a specific embodiment thereof, it is evident that many alternatives, modifications, and variations will be apparent to those skilled in the art. Accordingly, it is intended to embrace all such alternatives, modifications and variations that fall within the spirit and broad scope of the appended claims.

I claim:

1. A slide mechanism for mounting a sliding member to a housing, said mechanism comprising:

a body including first and second opposed surfaces, and one or more sets of arms, the sliding member being mountable to said body;

a plurality of journals extending from said body, each of said plurality of journals having a central axis thereof, said body and said plurality of journals being molded from a moldable material and having a one piece construction; and a plurality of rollers, each of said plurality of rollers rotatably fitted to one of said plurality of journals, said plurality of rollers operably connectable to the housing wherein the one or more sets of arms are adapted to provide relative motion of at least one of the journals with respect to at least one other journal.

2. The slide mechanism according to claim 1, wherein the sliding member is fixedly mountable to said body.

3. The slide mechanism according to claim 1, wherein at least two of said central axes being substantially parallel to each other.

4. The slide mechanism according to claim 1, wherein at least one said body and said plurality of journals comprise at least one of polyamide or polyoxymethylene.

5. The slide mechanism according to claim 1, further comprising a member securable to the housing, said plurality of rollers slidably fittable to said member.

6. The slide mechanism according to claim 1, wherein said plurality of journals comprises:

a first set of journals, the centerlines of said first set of journals being coplanar to each other, the centerlines of said first set of journals defining a first plane;

a second set of journals, the centerlines of said second set of journals being coplanar to each other, the centerlines of said second set of journals defining a second plane spaced from and parallel to said first plane.

7. A slide mechanism for mounting a sliding member to a housing, said mechanism comprising:

a body including first and second opposed surfaces, the sliding member being mountable to said body;

a plurality of journals extending from said body, each of said plurality of journals having a central axis thereof, said plurality of journals including a first set of journals, the centerlines of said first set of journals being coplanar to each other, the centerlines of said first set of journals defining a first plane and a second set of journals, the centerlines of said second set of journals being coplanar to each other, the centerlines of said second set of journals defining a second plane spaced from and parallel to said first plane said body including a resilient feature to provide for relative motion of at least one of said journals of said first set of journals with respect to at least one of said journals of said second set of journals; and a plurality of rollers, each of said plurality of rollers rotatably fitted to one of said plurality of journals, said plurality of rollers operably connectable to the housing, at least one of said body and said plurality of journals being molded from a moldable material.

8. The slide mechanism according to claim 7, wherein said resilient feature comprises a pair of spaced apart arms integral with the body, at least one of said journals connected to said pair of arms.

9. The slide mechanism according to claim 7, wherein said arms are arcuate.

10. A slide mechanism for mounting a sliding member to a housing, said mechanism comprising:

a body including first and second opposed surfaces, the sliding member being mountable to said body;

a plurality of journals extending from said first surface of said body, each of said plurality of journals having a central axis thereof, said plurality of journals including a first set of journals, the centerlines of said first set of journals being coplanar to each other, the centerlines of said first set of journals defining a first plane, said plurality of journals further including a second set of journals, the centerlines of said second set of journals being coplanar to each other, the centerlines of said second set of journals defining a second plane spaced from and parallel to said first plane;

a member securable to the housing; and a plurality of rollers, each of said plurality of rollers being rotatably fitted to one of said plurality of journals, said plurality of rollers being slidably fittable to said member, said body having a resilient feature to provide for relative motion of at least one of said journals of said first set of journals with respect to at least one of said journals of said second set of journals.

11. An electrophotographic printing machine having a slide mechanism for mounting a sliding member to a housing, said slide mechanism comprising:

a body including first and second opposed surfaces, the sliding member being mountable to said body;

a plurality of journals extending from said body, each of said plurality of journals having a central axis thereof, said body and said plurality of journals being molded from a moldable material and having a one piece construction; and a plurality of rollers, each of said plurality of rollers rotatably fitted to one of said plurality of journals, said plurality of rollers operably connectable to the housing wherein the body and at least one of the plurality of journals are adapted to functionally operate together to provide resiliency therebetween.

12. The printing machine according to claim 11, wherein the sliding member is fixedly mountable to said body.

13. The printing machine according to claim 11, wherein at least two of said central axes being substantially parallel to each other.

14. The printing machine according to claim 11, wherein at least one said body and said plurality of journals comprise at least one of polyamide or polyoxymethylene.

15. The printing machine according to claim 11, further comprising a member securable to the housing, said plurality of rollers slidably fittable to said member.

16. The printing machine according to claim 11, wherein said plurality of journals comprises:

a first set of journals, the centerlines of said first set of journals being coplanar to each other, the centerlines of said first set of journals defining a first plane;

a second set of journals, the centerlines of said second set of journals being coplanar to each other, the centerlines of said second set of journals defining a second plane spaced from and parallel to said first plane.

17. An electrophotograghic printing machine having a slide mechanism for mounting a sliding member to a housing, said slide mechanism comprising:

a body including first and second opposed surfaces, the sliding member being mountable to said body;

a plurality of journals extending from said body, each of said plurality of journals having a central axis thereof, said plurality of journals including a first set of journals, the centerlines of said first set of journals being coplanar to each other, the centerlines of said first set of journals defining a first plane and a second set of journals, the centerlines of said second set of journals being coplanar to each other, the centerlines of said second set of journals defining a second plane spaced from and parallel to said first plane said body including a resilient feature to provide for relative motion of at least one of said journals of said first set of journals with respect to at least one of said journals of said second set of journals; and a plurality of rollers, each of said plurality of rollers rotatable fitted to one of said plurality of journals, said plurality of rollers operably connectable to the housing, at least one of said body and said plurality of journals being molded from a moldable material.

18. The printing machine according to claim 17, wherein said resilient feature comprises a pair of spaced apart arms integral with the body, at least one of said journals connected to said pair of arms.

19. The printing machine according to claim 17, wherein said arms are arcuate.

* * * * *